US007756796B2

(12) United States Patent
Bodie et al.

(10) Patent No.: US 7,756,796 B2
(45) Date of Patent: Jul. 13, 2010

(54) UTILIZING A UNIQUE TRACKING IDENTIFIER FOR SORTING MAIL

(75) Inventors: Kevin W. Bodie, Brookfield, CT (US); Edward P. Daniels, Jr., Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 3137 days.

(21) Appl. No.: 09/957,288

(22) Filed: Sep. 20, 2001

(65) Prior Publication Data

US 2003/0055791 A1 Mar. 20, 2003

(51) Int. Cl.
*B65B 35/00* (2006.01)

(52) U.S. Cl. ..... 705/406

(58) Field of Classification Search ..... 705/400–410
See application file for complete search history.

(56) References Cited

U.S. PATENT DOCUMENTS 5,420,403 A * 5/1995 Allum et al. ..... 235/375
5,459,670 A * 10/1995 Johnson et al. ..... 700/224
5,510,608 A * 4/1996 Williams ..... 235/494
5,514,863 A * 5/1996 Williams ..... 235/494
5,640,835 A * 6/1997 Muscoplat ..... 53/569
5,659,163 A * 8/1997 Lagan et al. ..... 235/375
6,135,292 A * 10/2000 Pettner ..... 209/603
6,203,002 B1 * 3/2001 Ference ..... 271/2
6,244,763 B1 * 6/2001 Miller ..... 400/76
6,459,953 B1 * 10/2002 Connelly et al. ..... 700/224
6,461,063 B1 * 10/2002 Miller et al. ..... 400/76
6,501,041 B1 * 12/2002 Burns et al. ..... 209/584
2002/0070149 A1 * 6/2002 Schererz et al. ..... 209/540

OTHER PUBLICATIONS

"Mail Priorities", Sobie, Brendan, Air Cargo World, Mar. 1999, v89n3, pp. 14.*

* cited by examiner

*Primary Examiner*—John W Hayes
*Assistant Examiner*—Rob Wu
(74) *Attorney, Agent, or Firm*—Steven J. Shapiro; Angelo N. Chaclas

(57) ABSTRACT

A method and system for enabling a mailer to sort incoming mail pieces in accordance with changeable criteria that are important to the mailer. This invention accomplishes the foregoing by placing a unique identifier or code tying the mail piece to a data file on each business reply envelope, on or in each windowed envelope or post card that is sent to a customer and returned to the mailer. The unique identifier would enable the mailer to establish parameters for evaluating the unique identifier so as to set a priority for processing mail that is in the mail stream, i.e. prioritize mail that is received just before a late fee is due to improve customer relations. The code tying the mail piece to a data file may be used by the mailer to track payment cycles, order the sortation of incoming mail based upon credit balances, process mail based upon the expected amount of the enclosed check. The foregoing would enable the mailer to receive monies earlier and improve the mailers cash flow.

21 Claims, 5 Drawing Sheets

UTILIZING A UNIQUE TRACKING IDENTIFIER FOR SORTING MAIL

FIELD OF THE INVENTION

The invention relates generally to the field of processing mail and, more particularly, to the sorting of incoming mail in accordance with the relative importance of the mail to the recipient.

BACKGROUND OF THE INVENTION

Large business mailers prepare and process various types of business mail utilizing high speed inserters to collate the sheets and stuff the same into envelopes. Invoices, advertisements for the purchase of goods and/or services, prepaid post cards as well as business reply envelopes are usually placed in the envelopes mailed by large business mailers. Recipients of business mailers mail may enclose a check and invoice and/or an advertisement order form in the business reply envelope and mail it to the business mailer. Recipients of business mailers mail may also supply information requested in the prepaid post card and mail the post card to the business mailer.

When the business mailer receives the business reply envelopes and/or prepaid or customer paid post cards from their customers, they process the mail in the order it is received. There is nothing on the mail piece that indicates to the business mailer the relative importance of the mail piece. For instance, an enclosed check for $1.00 is handled exactly the same as a check for $1,000,000.00.

As the prior art advanced, department identification codes in machine or human-readable format were placed on business reply envelopes and post cards. The identification codes increased the efficiency of the incoming mail sortation process. However, there was still no indication on the mail piece that indicated to the business mailer the relative importance of the mail piece. Thus, each department continued to process the mail in the order it was received.

SUMMARY OF THE INVENTION

The present invention overcomes the disadvantages of the prior art by enabling a mailer to sort incoming mail pieces in accordance with changeable criteria that are important to the mailer. This invention accomplishes the foregoing by placing a code on the mail piece to determine the priority for processing each business reply envelope, windowed envelope, or post card that is sent to a customer and returned to the mailer. The invention also teaches the placing of a unique identifier tying the mail piece to a data file or utilizing the information in the unique identifier to determine the priority for processing each business reply envelope, windowed envelope, or post card that is sent to a customer and returned to the mailer. The unique identifier would enable the mailer to establish parameters for evaluating the unique identifier so as to set a priority for processing mail that is in the mail stream, i.e., prioritize mail that is received just before a late fee is due, to improve customer relations. The code tying the mail piece to a data file may be used by the mailer to track payment cycles, order the sortation of incoming mail based upon credit balances, process mail based upon the expected amount of the enclosed check. The foregoing would enable the mailer to receive monies earlier and improve the mailers cash flow.

The mailer may use the information it obtains from the unique identifier and/or data file to revise the way it handles mail. For instance, the data may indicate which people pay bills when they receive them, which people pay bills on a certain day of the month, and which people pay bills when they are due, etc. Thus, the mailer schedule the sending of invoices to different people at different times of the month to improve the mailer's cash flow. Data obtained from the unique identifier and/or data file may also be used to determine the transit time from the customer to the mailer; determine the effectiveness of inserted advertising material; customer response time; determine early notification of mail in transit for quality control and to decrease customer inquiries; determine priority sorting based upon prior knowledge of mail stream contents, etc.

DETAILED DESCRIPTION OF THE PREFERRED EMBODIMENT

Figure 1:
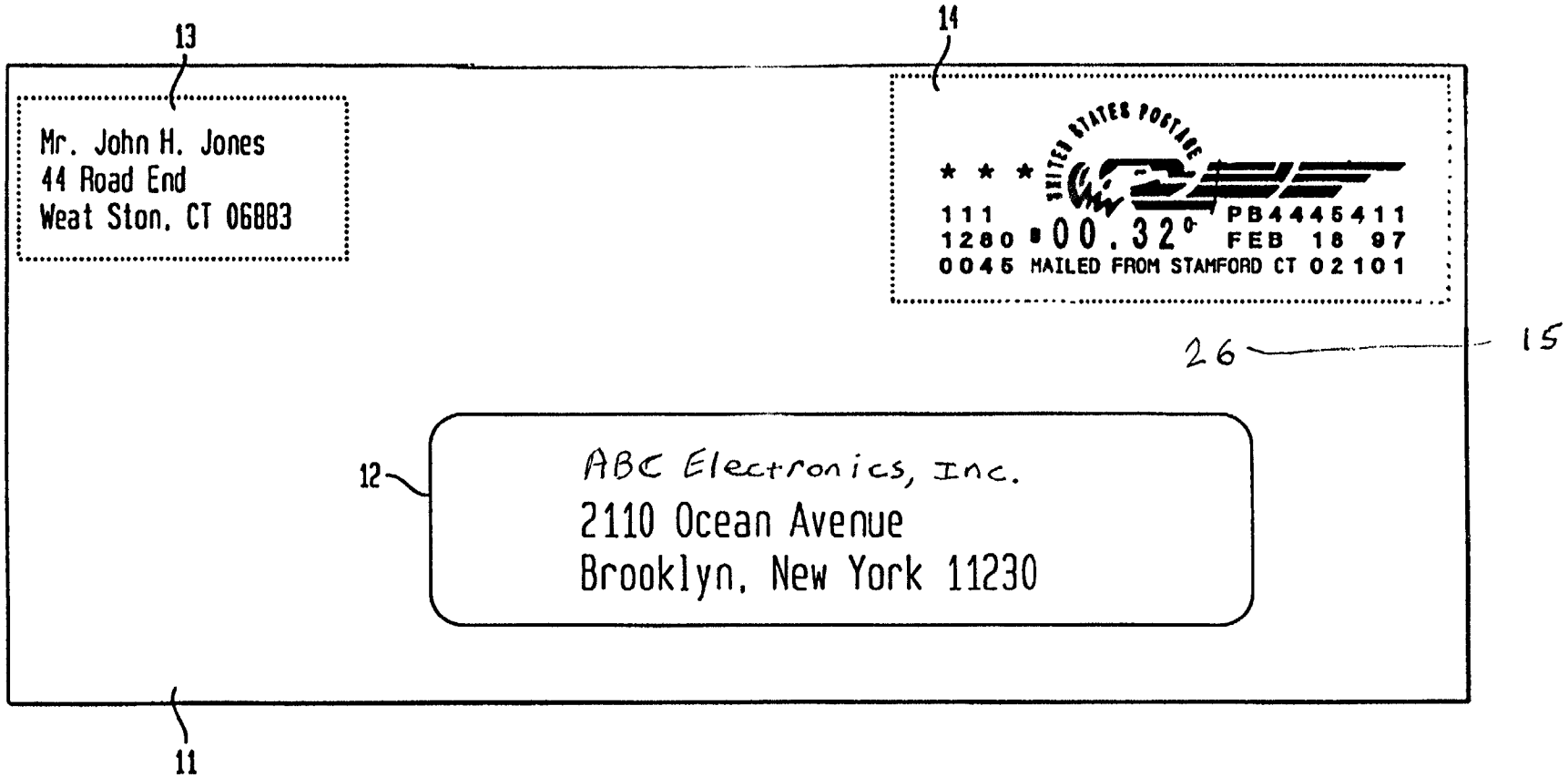
FIG. 1 is a drawing of a mail piece containing a sorting code.

Referring now to the drawings in detail, and more particularly to FIG. 1, the reference character 11 represents a business reply mail piece that is being returned to seller ABC Electronics, Inc. by customer Mr. John H. Jones. Mail piece 11 has a recipient address field 12 and a sender address field 13. A postal indicia 14 or other indication that indicates that postage has been paid or will be paid is affixed to mail piece 11. Mail piece 11 also contains a sorting code 15. Sorting code 15 may be any number of alphanumeric characters long that is used by the seller for sortation of the mail. For instance, the sorting code 15 may indicate that mail piece 11 is to be delivered to the television marketing department, and sorting code 15 may indicate that the seller considers mail of this classification to be of major importance and will be processed first. It will be obvious to one skilled in the art that the seller may use sorting code 15 for various sortation schemes.

Figure 2:
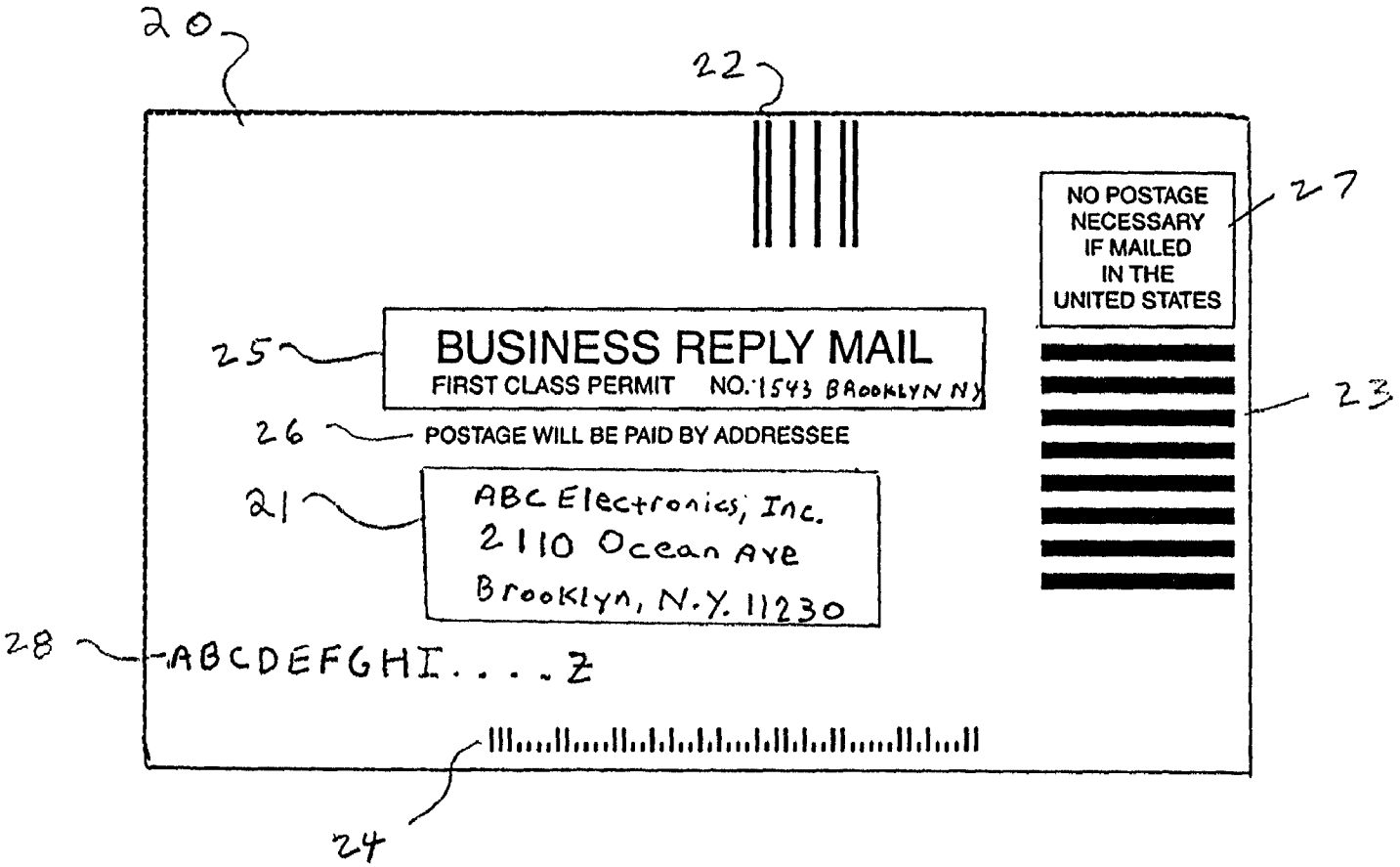
FIG. 2 is a drawing of a mail piece containing an identifier 28 that may associate a mail piece with a data file.

FIG. 2 is a drawing of a mail piece containing a unique identifier that may associate a mail piece with a data file. Business reply mail piece 20 is being returned to seller ABC Electronics, Inc. by a customer whose name does not appear on the face of mail piece 20. Mail piece 20 has a recipient address field 21; a facing identification mark 22; horizontal bars 23; a posnet bar code 24; a section 25 indicating that the mail piece is a permit mail business reply mail piece; marking 26 indicating that the addressee, i.e., ABC Electronics, Inc. will pay the postage for mailing mail piece 20; and an indication 27 that the customer sender does not have to pay for the mailing of mail piece 20.

The processing application will contain data mapping applications to use the information contained in identifier 28. Identifier 28 may also be indexed to a database. This permits a virtually infinite amount of information concerning mail piece 20 to be stored and matched on inbound mail flow. This allows full, closed-loop, trackable mail.

Mail piece 20 also contains identifier 28 that was placed on mail piece 20 by seller ABC Electronics, Inc. to identify the customer who mailed mail piece 20 and/or indicate information about the contents of mail piece 20, and/or information about the customer who mailed mail piece 20, etc. Identifier 28 is a series of data (alphabetic, numeric or alphanumeric), that identifies the customer and/or information that the seller considers important. For instance, data field A may represent the date the statement enclosed in mail piece 20 was prepared; data field B may represent the dollar balance of the statement contained in mail piece 20; data field C may indicate or represent the customer's account number; data field D may represent the customer's sub account number; data field E may represent the date that payment is due on the statement enclosed in mail piece 20; data field F may represent the catalogue in which mail piece 20 was placed; data field G may represent the department to which the seller wants mail piece 20 delivered; data field H may represent the date mail piece 20 was mailed to the customer, data field I may be a seller sorting priority code; data field J may be a seller priority code, etc. It will be obvious to one skilled in the art that the seller may use other seller-defined identifier 28 data fields to process mail piece 20. Identifier 28 may be any number of characters.

Identifier 28 may also be linked to one or more seller data files that contain processing information for mail piece 20 and/or other information the seller is interested in tracking. Identifier 28 may be a bar code; encrypted; or an encrypted bar code. It would be obvious to one skilled in the art that identifier 28 may replace sorting code 15 (FIG. 1) of mail piece 11, and sorting code 15 may replace identifier 28 of mail piece 20.

Figure 3:
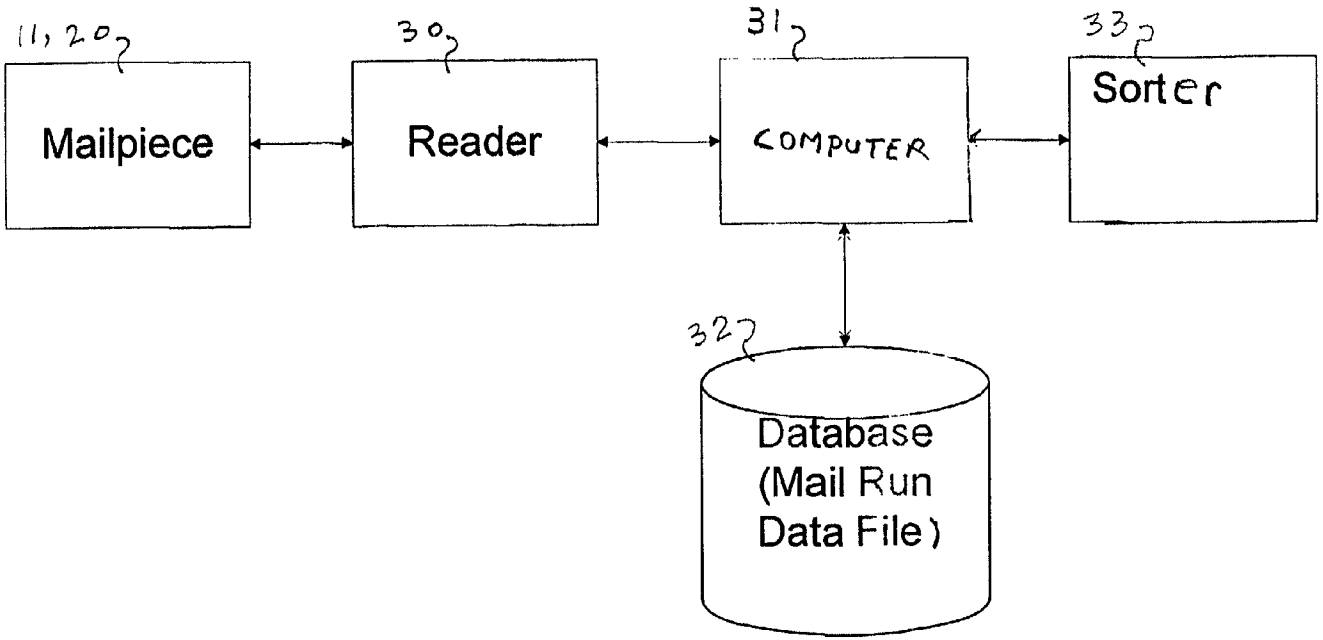
FIG. 3 is a block diagram showing the processing of incoming mail by the seller when identifier 28 references a data file.

FIG. 3 is a block diagram showing the processing of incoming mail by the seller when identifier 28 references a data file. After a carrier delivers mail piece 11 and/or mail piece 20 to the seller, a reader 30, i.e., a bar code or optical character recognition reader, etc., will scan identifier 28. Computer 31 will process identifier 28 by obtaining the mail run data files in data base 32. Data base 32 may have files for each of the data fields of identifier 28. Data base 32 will transmit the information in the selected data fields to computer 31, and computer 31 will cause sorter 33 to sort incoming mail pieces 11 and/or 20 into the bins of sorter 33 that represent the selected preferences indicated by the data fields.

Figure 4:
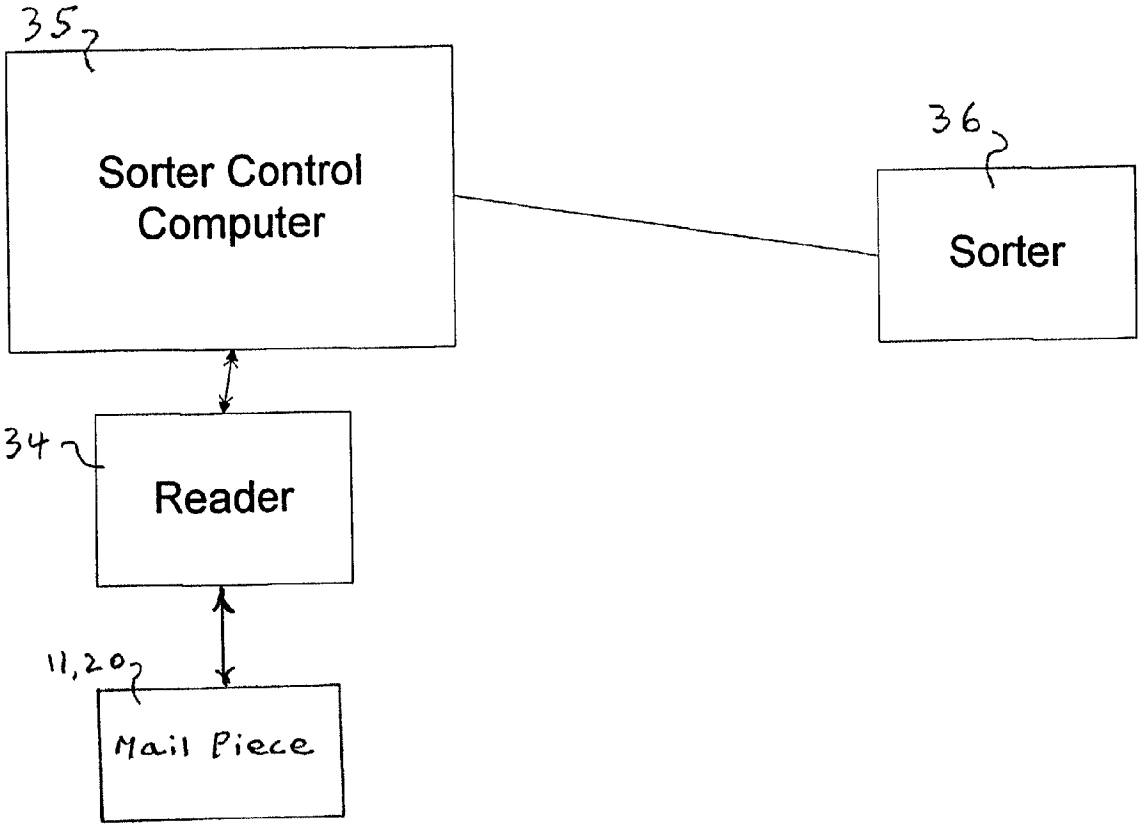
FIG. 4 is a drawing showing the processing of incoming mail by the seller using identifier 28 as a sole source of processing information.

FIG. 4 is a drawing showing the processing of incoming mail by the seller using identifier 28 as a sole source of processing information. After a carrier delivers mail piece 11 and/or mail piece 20 to the seller, a reader 34, i.e., a bar code or optical character recognition reader, etc., will scan identifier 28. Computer 35 will cause sorter 36 to process mail pieces 11 and/or 20 based upon identifier 28 and the control configuration of sorter 36. Thus, incoming mail pieces 11 and/or 20 will be placed into the bins of sorter 36 that represent the selected preferences indicated by indicator 28.

Figure 5:
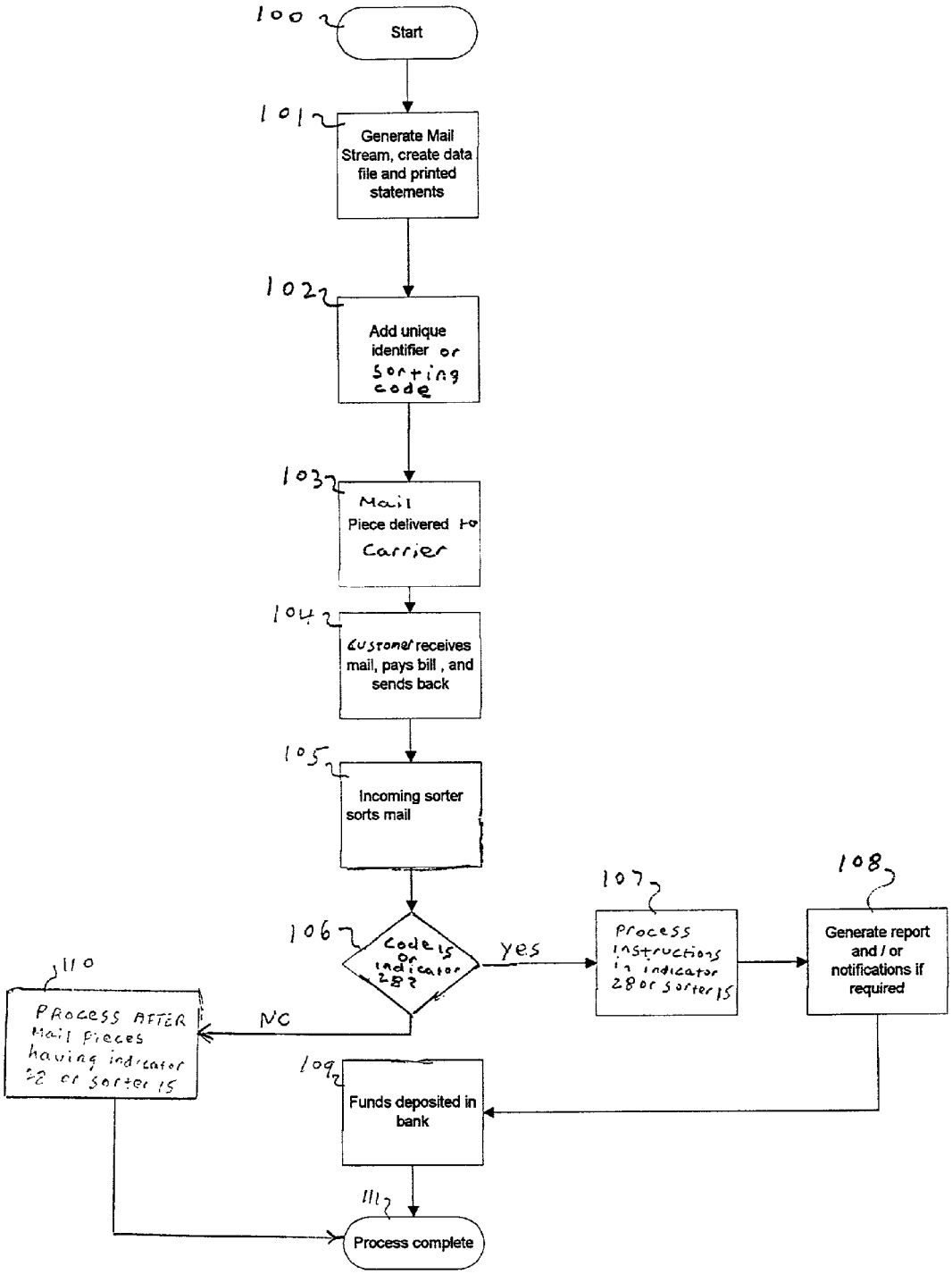
FIG. 5 is s a flow chart showing the processing of mail by the seller.

FIG. 5 is s a flow chart showing the processing of mail by the seller. The program begins in block 100. In block 101 the seller generates mail pieces 11 and 20 and other material, i.e., statements, etc. that are going to be inserted into the mail pieces 11 and 20 that are going to be sent to the customer. Data files are also generated in block 101. Then the program goes to block 102 to add unique identifier 28 or sorting code 15 to mail pieces 20 and 11. Also in block 102, mail pieces 11 or 20 and the material associated therewith are inserted into the mail piece that is going to be sent to the customer. Now the program goes to block 103 where the customer's mail piece containing mail pieces 11 or 20 is delivered to a carrier. Then in block 104, the customer receives the mail piece containing mail pieces 11 or 20 and other associated materials. The customer may also pay all or part of the statement contained in the mail piece addressed to the customer and/or respond to other material sent to the customer by placing a check and/or other material in mail pieces 11 and/or 20. Then in block 105, the sorter sorts incoming mail. At this point, the program goes to decision block 106. Decision block 106 determines whether or not sorting code 15 or indicator 28 on mail pieces 11 or 20 indicates specific instructions to handle mail piece 11 or mail piece 20. If block 106 determines that there are specific instructions regarding the handling of mail piece 11 or mail piece 20, the program goes to block 107. Block 107 processes mail piece 11 or 20 in accordance with the instructions specified by sorting code 15 or identifier 28. The instructions may include tracking and tracing, payment cycle, determination, advertising effectiveness, etc. Now in block 108, a report will be generated and/or the customer will receive required notifications. Then, in block 109, the customer's funds will be deposited in a bank. If block 106 determines that there are no specific instructions regarding the handling of mail piece 11 or mail piece 20, the program goes to block 110. Block 110 processes incoming mail that does not have a sorting code 15 or an indicator 28 after processing mail having a sorting code 15 or indicator 28. After processing mail that does not have a sorting code 15 or indicator 28, the program goes to block 109 where the customer's funds will be deposited in a bank. Then, in block 111, after processing all incoming mail, the process is complete.

The above specification describes a new and improved method for processing mail. It is realized that the above description may indicate to those skilled in the art additional ways in which the principles of this invention may be used without departing from the spirit. Therefore, it is intended that this invention be limited only by the scope of the appended claims.

What is claimed is:

1. A method of sorting mail pieces utilizing a computer that are returned to a mailer by a customer, comprising the steps of:

placing by the mailer an identifier on the returned mail piece, before the mail piece is returned by the customer that contains information useful to the mailer, using a computer to sort the incoming returned mailpiece by the mailer in accordance with mailer priorities of processing the mailpiece by referencing one or more data files stored in the computer, wherein the mailer's priorities are a late fee date, a credit balance of the customer, an expected amount of payment by the customer, payment cycle, effectiveness of inserted advertisements, mailer cash flow, customer response time and quality control.

2. The method claimed in claim 1, wherein the identifier determines the manner in which the mailer processes the mail.

3. The method claimed in claim 1, wherein the identifier uniquely defines the customer.

4. The method claimed in claim 3, wherein the identifier is related to the customer's account.

5. The method claimed in claim 3, wherein the identifier is related to the customer's balance on a specific statement.

6. The method claimed in claim 5, wherein the identifier is related to the balance that is due on the customer's statement.

7. The method claimed in claim 3, wherein the identifier is related to a catalogue in which the returned mail piece was placed.

8. The method claimed in claim 3, wherein the identifier is related to a department to which the seller wants the mail piece delivered.

9. The method claimed in claim 3, wherein the identifier is related to the date the mail piece was mailed to the customer.

10. The method claimed in claim 1, wherein the identifier is encrypted.

11. The method claimed in claim 1, wherein the identifier is a bar code.

12. The method claimed in claim 1, wherein the identifier is an index to a data file.

13. The method claimed in claim 12, wherein the data file uniquely defines the customer.

14. The method claimed in claim 12, wherein the data file is related to the customer's account.

15. The method claimed in claim 12, wherein the data file is related to the customer's balance on a specific statement.

16. The method claimed in claim 12, wherein the data file is related to the balance that is due on the customer's statement.

17. The method claimed in claim 12, wherein the data file is related to a catalogue in which the returned mail piece was placed.

18. The method claimed in claim 12, wherein the data file is related to a department to which the seller wants the mail piece delivered.

19. The method claimed in claim 12, wherein the data file is related to the date the mail piece was mailed to the customer.

20. The method claimed in claim 1, wherein the identifier is related to a late fee that may be due.

21. The method claimed in claim 1, wherein information obtained about the mail piece may be used by the mailer to change the mailer's priorities for processing the mail pieces.

* * * * *